US007152593B2

(12) United States Patent
Sikora

(10) Patent No.: US 7,152,593 B2
(45) Date of Patent: Dec. 26, 2006

(54) IGNITION TERMINAL

(75) Inventor: Ken Sikora, Fort Wayne, IN (US)

(73) Assignee: Pent Technologies, Inc., Kendallville, IN (US)

( * ) Notice: Subject to any disclaimer, the term of this patent is extended or adjusted under 35 U.S.C. 154(b) by 0 days.

(21) Appl. No.: 11/104,191

(22) Filed: Apr. 12, 2005

(65) Prior Publication Data

US 2005/0224032 A1 Oct. 13, 2005

Related U.S. Application Data

(60) Provisional application No. 60/561,734, filed on Apr. 13, 2004.

(51) Int. Cl.
*F02P 3/02* (2006.01)

(52) U.S. Cl. ..... 123/634; 123/635; 123/143 C

(58) Field of Classification Search ..... 123/634, 123/635, 647, 143 C
See application file for complete search history.

(56) References Cited

U.S. PATENT DOCUMENTS 4,029,936 A * 6/1977 Schweitzer ..... 219/267
4,035,613 A * 7/1977 Sagawa et al. ..... 219/552
4,270,128 A * 5/1981 Drewett ..... 343/702
4,357,526 A * 11/1982 Yamamoto et al. ..... 219/544
5,548,268 A * 8/1996 Collins ..... 338/307
5,916,467 A * 6/1999 Shimada ..... 219/543
6,018,288 A * 1/2000 Waite et al. ..... 338/254
6,178,957 B1 1/2001 Widiger et al. ..... 123/634
6,199,484 B1 * 3/2001 Martinez-Tovar et al. ..... 102/202.4
6,516,142 B1 * 2/2003 Grant et al. ..... 392/451
6,539,171 B1 * 3/2003 VonArx et al. ..... 392/451
6,668,810 B1 12/2003 St. John et al. ..... 123/634
6,744,978 B1 * 6/2004 Tweedy et al. ..... 392/451
6,747,543 B1 * 6/2004 Lim ..... 338/50
2005/0001783 A1 * 1/2005 Wang et al. ..... 343/895
2005/0085136 A1 * 4/2005 Zhang et al. ..... 439/700

* cited by examiner

*Primary Examiner*—Hai Huynh
(74) *Attorney, Agent, or Firm*—Taylor & Aust, P.C.

(57) ABSTRACT

An ignition terminal assembly including a serpentine conduction element having an end and a formed terminal connected to said end.

10 Claims, 2 Drawing Sheets

IGNITION TERMINAL

CROSS REFERENCE TO RELATED APPLICATIONS

This is a non-provisional application based upon U.S. provisional patent application Ser. No. 60/561,734, entitled "IGNITION TERMINAL", filed Apr. 13, 2004.

BACKGROUND OF THE INVENTION

1. Field of the Invention

The present invention relates to an electrical assembly, and, more particularly, to an ignition terminal assembly.

2. Description of the Related Art

Gasoline engines are one type of internal combustion engines that have cylinder blocks, which contain individual cylinders. Each cylinder is closed at one end by a cylinder head that is attached to the engine block. A piston moves within the cylinder to transfer energy from expanding gases into mechanical movement. In a spark-ignition engine a cylinder head contains sparkplug holes, which are threaded to receive spark plugs therein. Each spark plug includes a central electrical terminal that is available for connection with a mating terminal that is electrically connected to a spark ignition system.

A high voltage ignition coil is typically placed in electrical connection with each spark plug at an appropriate time and an electrical excitation of the ignition coil causes a high voltage pulse to transfer from the coil along a conduction element through an ignition terminal to the spark plug. The spark plug has a gap across which the electrical high voltage arcs causing the fuel in the cylinder, which has been compressed by the piston to ignite.

Electromagnetic interference from the passing of high voltage to the spark plug and the arcing within the cylinder can lead to undesirable electromagnetic interference.

What is needed in the art is a cost effective terminal that effectively reduces electromagnetic interference.

SUMMARY OF THE INVENTION

The present invention, in one form thereof, comprises an ignition terminal assembly including a serpentine conduction element having an end and a formed terminal connected to the end.

The present invention, in another form thereof, comprises a method of forming an ignition terminal assembly including the steps of forming a serpentine element in a planar form and bending the serpentine element into a quasi-cylindrical shape.

An advantage of the present invention is that the serpentine shape adds resistance to the terminal assembly and forms a resilient spring-like construct.

Yet another advantage is that the terminal may be formed from a planar material.

Yet another advantage of the present invention is that a serpentine conduction path may be formed around a resistive element.

Yet another advantage of the present invention is that the interaction of a serpentine conduction path and a resistive element allows a distributed resistive effect for reducing electromagnetic interference.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
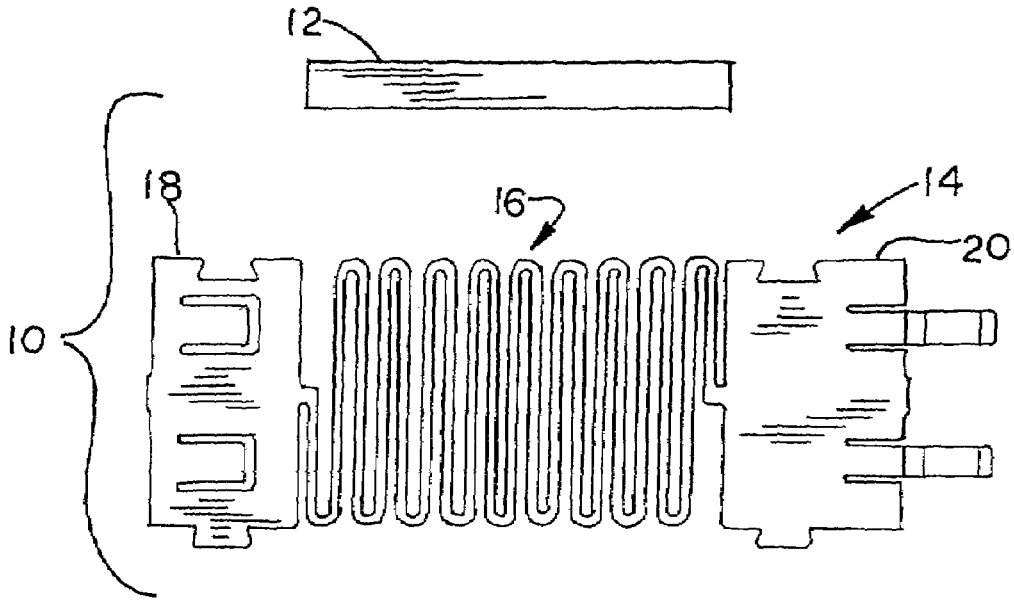
FIG. 1 illustrates two elements of an embodiment of the ignition terminal assembly of the present invention.
Figure 2:
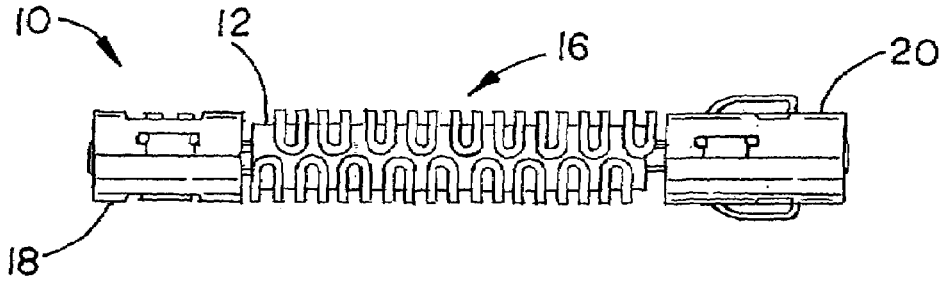
FIG. 2 is a side view of the ignition terminal assembly of FIG. 1.
Figure 3:
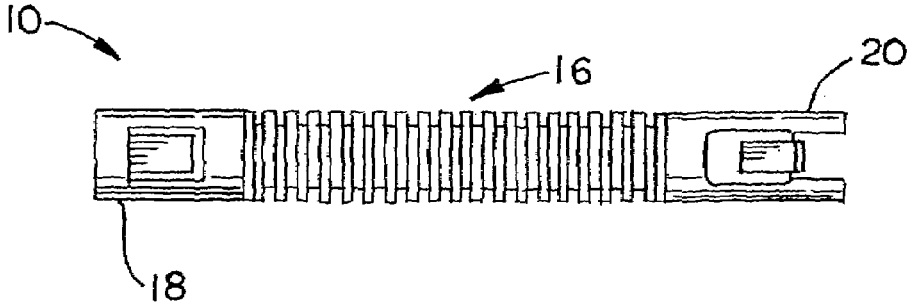
FIG. 3 is another side view of the ignition terminal assembly of FIGS. 1 and 2.

Referring now to the drawings, and more particularly to FIGS. 1–3, there is illustrated an ignition terminal assembly 10 including a resistive element 12, a serpentine conduction element 16, a first terminal 18 and a second terminal 20. Resistive element 12, which may be a ferrite resistor 12 is of a generally cylindrical shape having an electrical resistive property.

As shown in FIG. 1, a flat form 14 is cut or stamped resulting in a serpentine conduction element 16, first terminal 18 and a second terminal 20 all in a flat form. Serpentine conduction element 16 has a quasi-sinusoidal path that conductively links terminal 18 in terminal 20. The quasi-sinusoidal shape of serpentine conduction element 16 increases the electrical resistance between terminal 18 and terminal 20, due to its narrow cross-section. Additionally, the resilient nature of the material of ignition terminal assembly 10 allows serpentine conduction element 16 to provide a spring-like interaction between terminal 18 and terminal 20.

Serpentine conduction element 16 along with first terminal 18 and second terminal 20 are formed into a cylindrical or quasi-cylindrical shape as shown in FIGS. 2 and 3. Ferrite resistor 12 can be utilized as an internal form in the forming process of serpentine conduction element 16 or ferrite resistor 12 may be inserted therein after the forming of the cylindrical-like shape of serpentine conduction element 16. As can be seen in FIG. 2, the peaks and valleys of the quasi-sinusoidal shape do not touch, thereby allowing a distributed resistive effect to occur between terminal 18 and terminal 20. Ferrite resistor 12 co-acts with serpentine conduction element 16 to provide the distributed resistive effect. Serpentine conduction element 16 is in electrical contact with ferrite resistor 12 in a plurality of locations along the length of ferrite resistor 12. If force is applied along a longitudinal axis of ignition terminal assembly 10, serpentine conduction element 16 acts as a spring-like element and compresses or expands depending on the direction of the force applied thereto. The shape of serpentine conduction element 16, as illustrated in FIGS. 2 and 3, can be described as a cylindrical serpentine shape.

Terminals 18 and 20 are formed and are either attached to serpentine conduction element 16 or are formed as an integral assembly as illustrated in FIGS. 1–3. Terminals 18 and 20 each have projections which interact with an open slot to thereby retain the shape of terminals 18 and 20.

Figure 4:
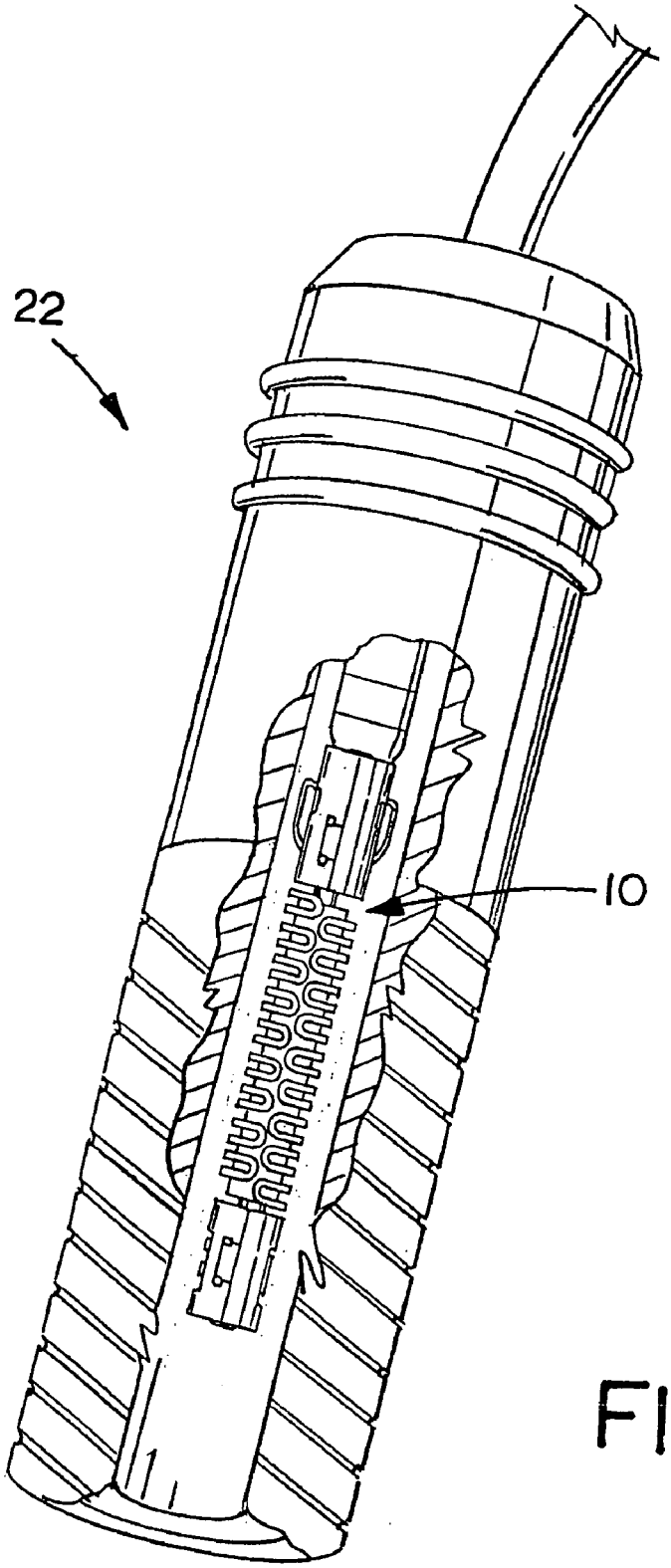
FIG. 4 is an application of the ignition terminal assembly of FIGS. 1–3 in a sparkplug interface module.

Referring now to FIG. 4, there is shown an assembly 22 that incorporates the use of ignition terminal assembly 10 therein. Assembly 22 may be a spark plug wire terminal or a separate ignition device either of which provide high voltage to terminal 20. Assembly 10 can advantageously be used in either type of application.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ignition terminal assembly, comprising:

a serpentine conduction element having an end; and a formed terminal connected to said end, said serpentine conduction element having a spring-like interaction with said formed terminal.

2. The assembly of claim 1, further comprising a resistive element substantially surrounded by said serpentine conduction element.

3. The assembly of claim 2, wherein said serpentine conduction element does not touch itself.

4. The assembly of claim 2, wherein said resistive element is substantially cylindrical.

5. The assembly of claim 4, wherein said serpentine conduction element is in electrical contact with said resistive element at a plurality of locations.

6. The assembly of claim 5, wherein said resistive element is a ferrite resistor.

7. The assembly of claim 1, wherein said serpentine conduction element has a quasi-sinusoidal shape.

8. The assembly of claim 1, wherein said serpentine conduction element is formed in a substantially cylindrical manner giving said serpentine element a cylindrical serpentine shape.

9. The assembly of claim 8, wherein said serpentine conduction element has a longitudinal axis and is resilient along said axis.

10. The assembly of claim 9, further comprising an other terminal, said serpentine conduction element having an other end, said other terminal being one of attached to and integral with said other end.

* * * * *